United States Patent [19]

Seno et al.

[11] 4,015,231

[45] Mar. 29, 1977

[54] VARIABLE RESISTORS

[75] Inventors: Shougo Seno, Yokohama; Masao Takeda, Osaka, both of Japan

[73] Assignee: Hitachi, Ltd., Japan

[22] Filed: Apr. 7, 1975

[21] Appl. No.: 565,373

[30] Foreign Application Priority Data

Apr. 10, 1974 Japan ..... 49-39995

[52] U.S. Cl. ..... 338/174; 338/312

[51] Int. Cl.[2] ..... H01C 10/34

[58] Field of Search ..... 338/174, 329, 312, 308; 174/68.5; 317/101

[56] References Cited

UNITED STATES PATENTS

| | | | |
|---|---|---|---|
| 2,777,192 | 1/1957 | Albright et al. | 317/101 B |
| 3,354,418 | 11/1967 | Casey et al. | 338/174 |
| 3,379,567 | 4/1968 | Wright | 338/195 X |
| 3,416,119 | 12/1968 | Van Benthuysen et al. | 338/174 |
| 3,429,040 | 2/1969 | Miller | 174/68.5 X |

*Primary Examiner*—J. V. Truhe
*Assistant Examiner*—D. A. Tone
*Attorney, Agent, or Firm*—Craig & Antonelli

[57] ABSTRACT

A variable resistor comprises an insulation plate, conductors of a cermet material formed on the insulation plate, a resistor of a cermet material formed on the insulation plate in contact with the conductors, a slider member adapted to move slidably on the resistor and portions of the conductors, and coatings of a cermet resistance material formed on the conductors at the portions which are slidably wiped by the slider member.

3 Claims, 6 Drawing Figures

VARIABLE RESISTORS

The present invention relates to a variable resistor.

In a hitherto known variable resistor, a resistance layer is formed on an insulation plate and adapted to be wiped by a slider member to change the resistance value. The resistance layer is contacted to conductor layers also formed on the insulation plate and having portions for external connections to which terminal members are soldered. In order to set the resistance value of the variable resistor to zero or maximum value, at least the portions of the conductor layers contacted to the resistance layer have to be wiped by the slider member. Such variable resistor of the conventional type has drawbacks which will be discussed in detail hereinafter. For example, when the terminal members are soldered to the portions of the conductor layers for the external connection, the solder material is likely to adhere to the portions of the conductor layers to be wiped by the slider member and provides difficulties for attaining the smooth movement of the slider member as well as for the mounting thereof.

An object of the present invention is to provide a novel and improved variable resistor.

Another object of the invention is to provide a variable resistor which can be inexpensively and easily manufactured.

Still another object of the invention is to provide a variable resistor which avoids the disadvantages of the conventional variable resistor such as described above and hereinafter by providing means to prevent solder material from adhering to the portions at least wiped by the slider member.

According to the present invention, it is proposed that the conductors formed on the insulation member are coated with a resistance material at the portions contacted to the resistance layer and wiped by the slider member at the rotation thereof. Further, the portion at which the slider member is mounted is also coated with the resistance material. Since solder material will not adhere to the resistance material, the conductor portions coated with the resistance material is protected from the adhesion of the solder material. According to the teaching of the present invention, the terminal pieces for the external connection can be soldered to the corresponding connecting portions of the variable resistor by using the flow soldering method, whereby the manufacturing of the variable resistor can be much facilitated.

Above and other objects as well as novel features and advantages of the present invention will become more apparent from the following description made with reference to the accompanying drawings, in which.

Figure 1:
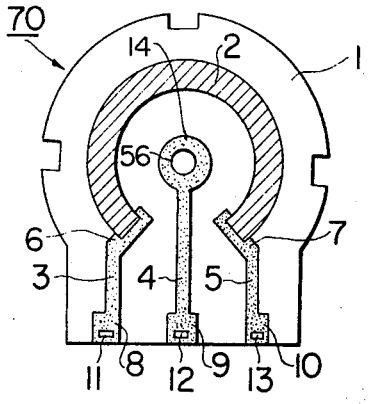
FIG. 1 PRIOR ART
FIG. 1 is a plan view showing an arrangement of resistance layer and conductors of a hitherto known variable resistor.

For the better understanding of the present invention, reference is first made to FIG. 1 which shows a hitherto known variable resistor. In the drawing, reference numeral 1 indicates a base plate of an insulation material on which there are deposited a layer of a resistance material 2 and electrically conductive strips 3, 4 and 5. The conductors 3 and 5 have respective connecting portions 6 and 7 to the resistor 2, while the conductor 4 is formed with a wiper mounting portion 14 at one end thereof at which a slidable wiper or slider member is mounted to be rotated by a shaft (not shown) mounted in a bore 56. Numerals 8, 9 and 10 denote terminals for external connection. The variable resistor which is composed of the above elements is generally indicated by reference numeral 70.

When it is desired to set the resistance value to zero or maximum value in the above described conventional variable resistor, the wiper mounted rotatably at the portion 14 of the conductor 4 has to be rotated to make contact with the connecting portion 6 or 7. To this end, the length of the connecting portions 6 and 7 is selected so as to be greater than the width of the resistance layer 2. The wiper is made of an electrically conductive material because it must be electrically connected to the portion 14. In case the external connecting portions 8, 9 and 10 of the variable resistor 70 are to be provided with respective terminal members for the external connection, the terminal members are inserted in the openings 11, 12 and 13 formed in the external connecting portions 8, 9 and 10 and soldered thereto. Such soldering may be carried out manually. However, it is obvious that the manual soldering will lower the production efficiency and involve high expensiveness in the manufacturing costs.

In order to avoid such disadvantages, it is contemplated that the connection of the terminal members to the connecting portions 8, 9 and 10 of the conductors 3, 4 and 5 may be effected by a so-called flow soldering process. In such case, however, the solder material will be deposited on the whole surfaces of the conductor layers 3, 4 and 5. If the solder is deposited on the connecting portions 6 and 7 of the conductors 3 and 5 contiguous to the resistance layer 2, there may arise a danger that the wiper can not be smoothly rotated. Further, if the solder is deposited on the wiper mounting portion 14 of the conductor 4, then it becomes impossible to mount the wiper of the variable resistor at this position. In case of the conventional variable resistor, the resistance layer 2 is usually formed of carbon, while the conductors 3, 4 and 5 are formed of silver. Accordingly, if the connecting portions 6 and 7 to the resistance layer 2 are abruptly subjected to the heat of the fused solder, these connecting portions 6 and 7 tend to likely be delaminated from the resistance layer 2 or may eventually be delaminated therefrom due to different expansion coefficients of the conductor materials 3, 4 and 5 and the resistance material 2. To evade such undesirable phenomena, it may be desirable that the connecting portions 6 and 7 as well as the wiper mounting portion 14 are previously provided with a film of a material to protect these portions from the deposition of the solder material. Such procedure is however time-consuming and disadvantageous in view of the material costs.

An object of the present invention is to provide an improved variable resistance in which the disadvantages of the conventional variable resistor such as above mentioned are substantially eliminated.

Now the invention will be described with reference to the annexed drawings which show preferred embodiments of the invention.

Figure 2:
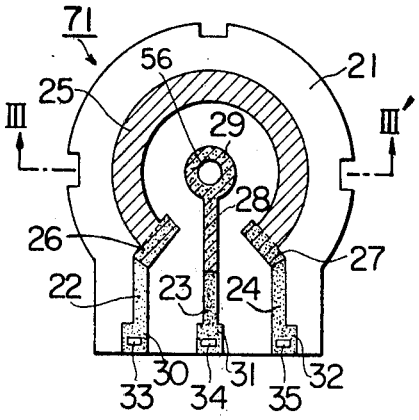
FIG. 2 is a plan view of a variable resistor subassembly embodying the invention.
Figure 3:
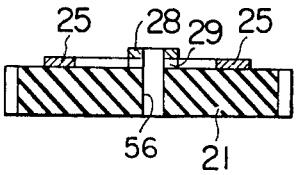
FIG. 3 is a sectional view of the device shown in FIG. 2 taken along the line III—III'.

Referring at first to FIGS. 2 and 3, reference numeral 21 indicates a base plate of an insulation material such as alumina porcelain on which is formed conductor layers 22, 23 and 24 of a sintered cermet material (i.e. ceramic metal material) containing electrically conductive material such as silver-palladium or the like. Numeral 25 denotes a resistance layer formed on the base plate 21 and made of a sintered cermet material containing resistance material such as ruthenium compounds, silver-palladium compounds or the like.

For the manufacturing of the variable resistor shown in FIG. 2, the cermet material containing electrically conductive material such as silver-palladium is at first printed on the base plate and after the firing treatment thereof, the cermet material containing a resistance material is subsequently applied to the base plate through a printing process and then fired. Alternatively, both of the cermet materials containing conductive material and resistance material, respectively, may be subjected simultaneously to the firing or sintering treatment after the application thereof on the base plate by printing.

It is to be noted that in case of the variable resistor subassembly 71 shown in FIG. 2 the portions of the conductors 22 and 24 to be connected to the resistance layer 25 are covered by resistance masses 26 and 27, while a portion of the conductor 23 as well as the wiper mounting portion 29 thereof are covered by resistance mass 28. In FIG. 2, numerals 30, 31 and 32 denote external connecting portions of the conductors 22, 23 and 24, respectively, having openings or holes 33, 34 and 35 formed therein for receiving connection terminal members (not shown) which are inserted into the holes from the rear side of the base plate 21. In this manner, the portions of the conductors 22 and 24 located at the terminations of a circular track sweeped by the slidable wiper rotatably mounted at the portion 29 are covered by the resistance materials 26 and 27 in the variable resistor subassembly 71 shown in FIG. 2.

The resistance material contains a large amount of glass components. When the cermet material containing such resistance material is subjected to the firing or sintering treatment, glass components are deposited at the surface of the sintered cermet material and serve to prevent the solder material from adhering to the resistance layers or coatings 25, 26, 27 and 28.

Thus, the soldering of the terminal members or pieces to the portions 30, 31 and 32 for the external connection can be carried out through the flow soldering method without involving difficulty in the mounting as well as the rotation of the sliding wiper or slider member, since no solder material will be deposited on the circular track sweeped by the wiper.

When the conductors 22, 23 and 24 are covered by the resistance materials 26, 27 and 28, the direct contact between the wiper and the conductors 22, 23 and 24 can not take place due to the interposed resistance materials 26, 27 and 28. However, because the layers of these resistance materials are extremely thin in thickness in the order of about 25 microns, resistance values of these interposed layers can be practically neglected.

The cermet material containing the resistance material is applied onto the insulation base plate 21 and the conductors 22, 23 and 24. When the application of the cermet material containing the resistance material is realized through the printing process, any abrupt offset will not be produced between the cermet material containing the resistance material applied onto the conductors 22, 23 and 24 and the cermet material printed on the insulation base plate 21. Furthermore, by sintering the cermet material containing the resistance material, glass components contained therein will be deposited at the surface of the resistance layers, which thus results in smooth surfaces of the resistance layers 25, 26 and 27. The wiper or slider member thus can be slidably moved smoothly on the resistance layers 26, 27 and 28.

In the embodiment shown in FIG. 2, the cermet material containing the conductive material and the cermet material containing the resistance material comprise similar main components and they are merely different from each other in respect of the contents of the glass. By virtue of this fact, the conductive and the resistance materials are fused together at the connected portions of the resistance and the conductor layers and no definite interface will be produced. Thus, application of heat will not bring about delamination between the conductor and the resistance layers at these portions.

In the variable resistor subassembly 71 shown in FIG. 2, the cermet material containing the resistance material can be printed simultaneously on the base plate 21 as well as on the desired portions of the conductors 22, 23 and 24 and subjected simultaneously to the firing treatment, which contributes to the enhanced production efficiency. Besides, according to the invention, no special material to inhibit the deposition of the solder material is required.

Figure 4:
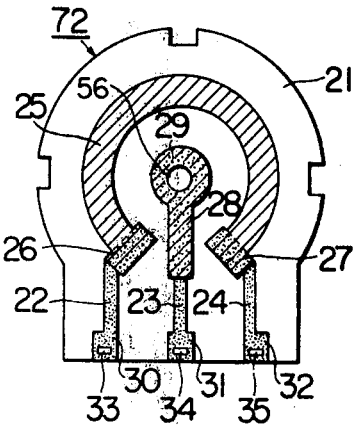
FIG. 4 is a plan view showing another embodiment of a variable resistor subassembly according to the invention.

FIG. 4 shows another embodiment of the invention. The variable resistor subassembly 72 according to this embodiment is differed from the one shown in FIG. 2 in that the resistance layers 26, 27 and 28 disposed on the conductors 22, 23 and 24 are of greater size than that of the latter. With such arrangement, the selected portions of the conductors 22, 23 and 24 are covered by the resistance materials 26, 27 and 28 without fail, even if a slight dislocation should occur in the position of the printed cermet material containing the resistance material. It will also be appreciated that the same advantages as those of the subassembly shown in FIGS. 2 and 3 can be equally attained in case of the embodiment shown in FIG. 4.

Next, a process of mounting a rotatable shaft and the wiper on the variable resistor subassembly described above to thereby construct a variable resistor will be described with reference to FIGS. 5 and 6.

Figure 5:
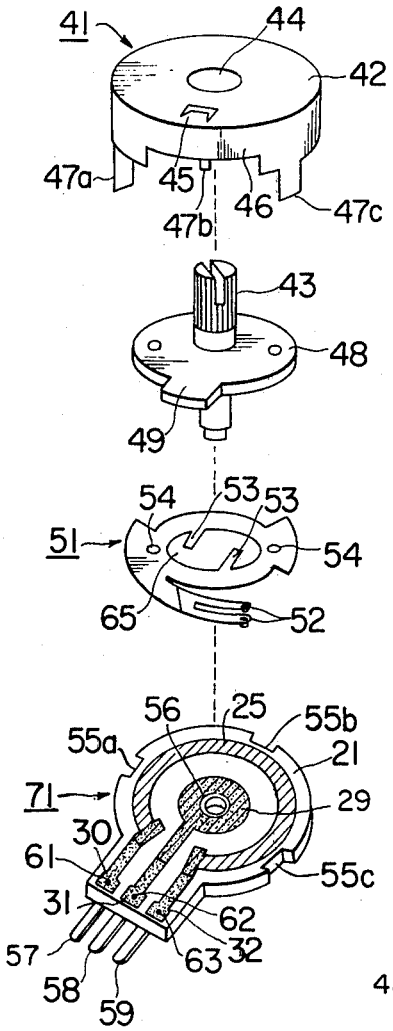
FIG. 5 is an exploded perspective view of a variable resistor according to the invention.

Referring to FIG. 5, numeral 41 denotes a metal case having a disk portion 42 which is formed with a bore 44 at the central portion thereof for receiving a rotating shaft 43. The disk portion 42 has additionally an ear 45 formed therein which serves as a stopper for rotation. The metal case 41 has a cylindrical side wall 46 extending perpendicularly from the disk portion 42, which side wall is formed with three legs 47*a*, 47*b* and 47*c*. Secured to the rotating shaft 43 is a rotatable disk 48 which is provided with a projection 49 at a peripheral portion to serve as a stopper for the rotation. Numeral 51 generally indicates a slider member which has first and second wiper arms 52 and 53. The slider member 51 is adapted to be fixedly secured to the rotatable disk 48 by means of screw (not shown) through screw holes 54.

The base plate 21 of the resistor subassembly 71 is formed with notches 55*a*, 55*b* and 55*c* for receiving the legs 47*a*, 47*b* and 47*c*. The base plate 21 is further formed with a bore 56 for the insertion of the rotating shaft 43. It will be noted that the portions 30, 31 and 32 for the external connection of the base plate 21 are formed with respective holes into which terminal members 57, 58 and 59 are inserted from the rear side of the base plate 21 and soldered thereto. Numerals 61, 62 and 63 designate solder material.

For mounting the rotating shaft 43, slider member 51 and the base plate 21 to the metal case 41, the rotating shaft portion extending downwardly from the rotatable disk 48 is inserted through the bore 65 formed in the slider member 51 thereby to secure the latter to the rotatable disk 48 fixed to the shaft 43. The rotating shaft 43 having the slider member 51 secured thereto is then inserted into the hole 44 of the metal case 41 at one end and into the bore 56 formed in plate 21 at its other end. Thereafter, the legs 47*a*, 47*b* and 47*c* of the metal case 41 are fitted to the notches 55*a*, 55*b* and 55*c* and bent inwardly, whereby the variable resistor assembly has been completed.

Figure 6:
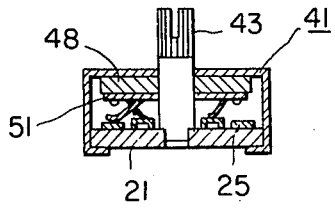
FIG. 6 is a schematic side view of a variable resistor according to the invention.

FIG. 6 shows the thus constructed variable resistor in a vertical sectional view.

In this variable resistor, the first wiper arms 52 are slidably moved on the inherent resistance layer 25, while the second wiper arms 53 are slidably moved on the resistance layer 28 printed on the conductor 29. The rotation of the shaft 43 is restricted by the projection 49 and the ear 45 serving as the stoppers. Although the second wiper arms 53 are moved on the resistance layer 28, it will be noted that the resistance between the second wiper arms 53 and the conductor 29 can be neglected, since the resistance layer 28 is very thin as hereinbefore mentioned. When the terminals 58 and 57 are connected to each other, the resistance between the terminals 58 and 59 is varied by rotating the shaft 43 with the first wiper arms 52 slidably moved on the resistance layer 25. According to the invention, even if the terminal members 57, 58 and 59 are secured to the connecting portions 30, 31 and 32 of the respective conductors 23, 24 and 25 through the flow soldering process, the solder material will not adhere to the portions which are swept by the slider arms 52 and 53. Thus, the slider arms 52 and 53 can be smoothly moved on the respective resistance layers 25 and 28. Additionally, since the conductor 29 is protected from the adhesion of the solder material by the resistance layer 28, the mounting of the slider member 51 and the rotating shaft 43 to the subassembly 71 of the variable resistor can be easily carried out.

What we claim is:

1. A variable resistor, comprising an insulation plate, a resistance layer of a cermet material formed on said insulation plate, at least one first conductive layer of a cermet material formed on said insulation plate and having one end in contact with one end portion of said resistance layer, a second conductive layer of a cermet material formed on said insulation plate so as to be spaced from said first conductive layer, a metallic slider member having first and second wiper members, means for supporting said slider member on said insulation plate with said first wiper member sliding on said resistance layer and over a selected portion of said first conductive layer and with said second wiper member sliding over a selected portion of said second conductive layer, and additional resistance layers of a cermet material formed on said first and said second conductive layers at least on said selected portions thereof over which said wiper members slide, so that said first and said second wiper members slide only on said resistance layers.

2. A variable resistor according to claim 1, wherein there is provided a third conductive layer of a cermet material formed on said insulation plate and having one end in contact with the other end portion of said resistance layer formed on said insulation plate, a selected portion of said third conductive layer over which said first wiper member is slidably moved being coated with a further resistance layer of cermet material.

3. A variable resistor according to claim 1, wherein at least one of said first and second conductive layers is soldered at a portion thereof other than said selected portion to a terminal means.

* * * * *